United States Patent [19]

Mavrakis et al.

[11] Patent Number: 4,959,917

[45] Date of Patent: Oct. 2, 1990

[54] CHOKE TUBE WRENCH FOR ANY GAUGE SHOTGUN

[76] Inventors: Stavros Mavrakis, 7725 Colonial Rd., Brooklyn, N.Y. 11209; Thomas R. Cresci, 58 Consant Ave., Staten Island, N.Y. 10314

[21] Appl. No.: 430,830

[22] Filed: Nov. 1, 1989

[51] Int. Cl.[5] ..... F41A 35/00

[52] U.S. Cl. ..... 42/90; 29/426.5; 81/3.05; 269/48.1

[58] Field of Search ..... 29/1.1, 426.5; 42/90; 81/3.05; 269/48.1

[56] References Cited

U.S. PATENT DOCUMENTS

| | | | |
|---|---|---|---|
| 314,563 | 3/1885 | Burton | 81/3.05 |
| 640,518 | 1/1900 | Adelman | 29/1.1 |
| 641,646 | 1/1900 | Parker | 29/1.1 |

*Primary Examiner*—Charles T. Jordan
*Assistant Examiner*—Richard W. Wendtland
*Attorney, Agent, or Firm*—Morgan & Finnegan

[57] ABSTRACT

A choke tube wrench is disclosed which greatly facilitates removal or installation of choke tubes by means of a cam-actuated expandable element which fits into the choke tube being changed. As the element expands it presses against the choke tube's interior, which keeps it from slipping. Projections on the wrench engage notches in the choke tube, helping to turn the tube.

4 Claims, 2 Drawing Sheets

CHOKE TUBE WRENCH FOR ANY GAUGE SHOTGUN

BACKGROUND OF THE INVENTION

1. Field of the Invention

The present invention relates generally to shotguns and more particularly to devices for removing and replacing shotgun choke tubes.

2. Description of the Related Art

Shotguns fire small ammunition pellets which, after leaving the shotgun barrel, tend to spread out before striking a target. The degree to which the pellets spread is controlled by a replaceable choke tube. These choke tubes are threaded on their outer surface and are screwed into matching threads machined in the gun barrel.

SUMMARY OF THE INVENTION

The present invention has been designed for utilization as a wrench to facilitate the removal and installation of various gauge shotgun choke tubes. This is accomplished in the following manner: The user inserts the wrench assembly into the choke tube mounted in the gun barrel, and aligns the projections of the wrench with corresponding notches at the end of the choke tube. The user then turns the wrench handle ninety degrees (90°), which rotates the cam 90°, thereby exerting tension along the puller bar. This tension exerted along the puller bar is also applied to the expanding element, and this further results in compression along the length of, and expansion along the diameter of the expanding element. This increase in the expanding element's diameter tightly secures the choke tube wrench into the choke tube of the gun barrel. The handle can now be used as a lever for the purpose of unscrewing the choke tube, and thereby disengaging it from the barrel. A choke tube can easily be mounted in a gun barrel by carrying out these steps in reverse order.

BRIEF DESCRIPTION OF THE DRAWINGS

Comprehension of the invention is facilitated by reading the following detailed description in conjunction with the annexed drawings, in which.

DETAILED DESCRIPTION

Figure 1:
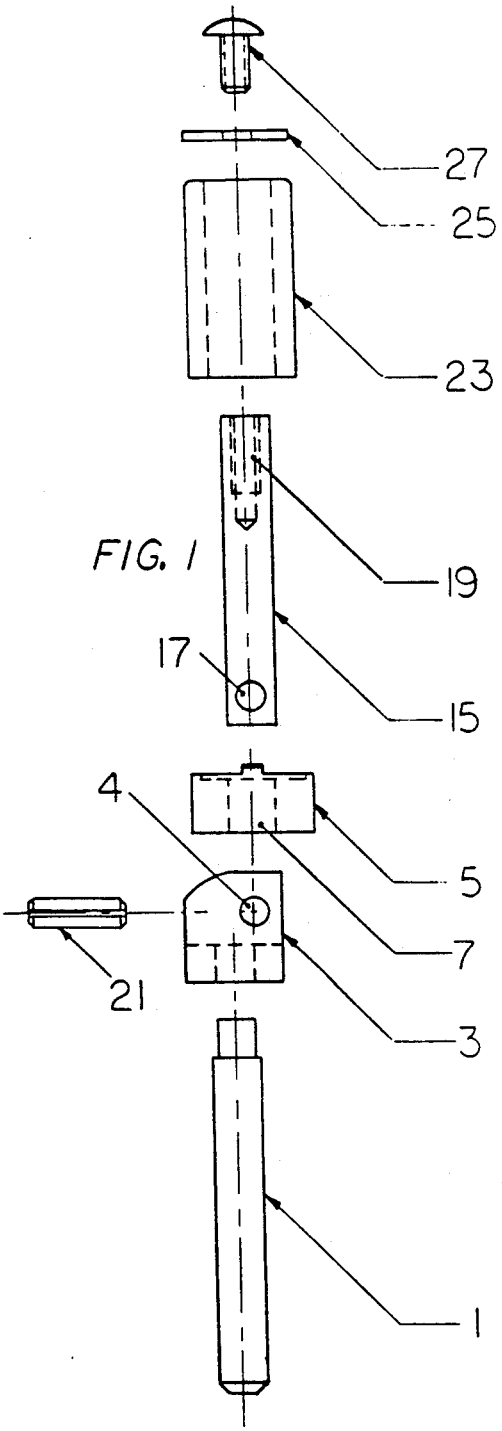
FIG. 1 is an exploded side view of the present invention.
Figure 2:
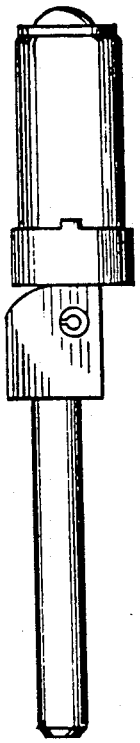
FIG. 2 is a side elevational view of the present invention ready for insertion into a shotgun choke tube.

FIG. 1 shows in exploded form the parts which together comprise the choke tube wrench.

The handle is made from any suitably rigid structural material and can be of any diameter and length. The part acts as a lever which rotates the cam 3, and also as a handle that facilitates turning the choke tube 13.

The cam 3 is a part made out of any structural material such as metal or hard plastics. The cam 3 has a bore 4 running through it. The cam 3 is shaped so that when the cam is rotated about ninety degrees (90°) so as to lie approximately perpendicular to the gun barrel 29 the bore 4 moves away from the choke key 5.

The choke key 5 can be made out of any structural material such as metal, and can be of any dimension. The choke key 5 can be any regular geometric shape, but is preferably round, which avoids sharp edges. The exact size and shape of a choke key 5 is dictated by the size of the choke tubes 13 used in various gauge shot guns. The choke key 5 also contains a hole 7 of a which can transmit torque. The choke key 5 also includes two (2) or more projections 9 which fit into the notches 11 of the choke tube, 13 thereby acting as the key which turns the choke tube 13 as the wrench is turned.

The puller bar 15 is made from any structural material such as metal or hard plastics, and can be of any suitable length. Its shape is determined by and corresponds to the shape of the hole 7 in choke key 5. The puller bar 15 passes through and is free to slide in the choke key 5. One end of the puller bar 15 includes a hole 17 by which it can be attached to the cam 3 using a pin 21 or other fastener. The alternate end of the puller bar has a threaded hole 19.

The roll pin 21 connects the cam with the puller bar 15, and can be a roll pin 21 (as illustrated), a solid pin, or even a nut and bolt. The roll pin 21 can be of any length, diameter, and any structural material. It secures the two parts in such a way as will tolerate relative rotation of the two parts around the pin 21.

The expanding element 23 is a cylindrical member that can be made in any length. Its length is determined by the length of the puller bar 15. When the cam 3 is rotated so as to pull the puller bar 15 toward it, the diameter of the expanding element 23 increases. This causes the expanding element 23 to press tightly against the inside of the choke tube 13.

The washer 25 is a part made of any structural material and whose diameter can vary according to the various shotgun gauges. The washer 25 is narrower than the gun barrel bore 31. The washer 25 holds the expanding element 23 against the choke key 5 and transmits force exerted by the puller bar 15 to the expanding element 23 when the bar is down toward the cam 3.

The screw 27 is the part that completes the assembly of the choke tube wrench. The screw 27 has threads that engage the threads 16 of the puller bar 15 and so it holds the sub-assembly of the handle 1, cam 3, and puller bar 15 together with the choke key 5, expanding element 23, and washer 25 thereby completing the assembly.

Figure 3:
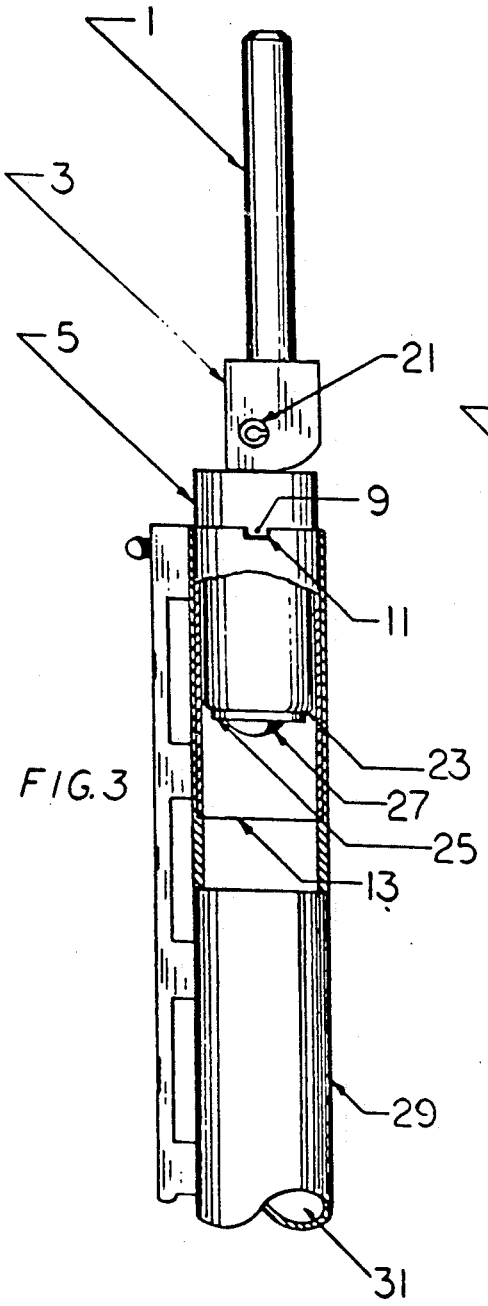
FIG. 3 is a side elevational view with partial sectional view of the present invention as inserted but not secured into a shotgun choke tube.
Figure 4:
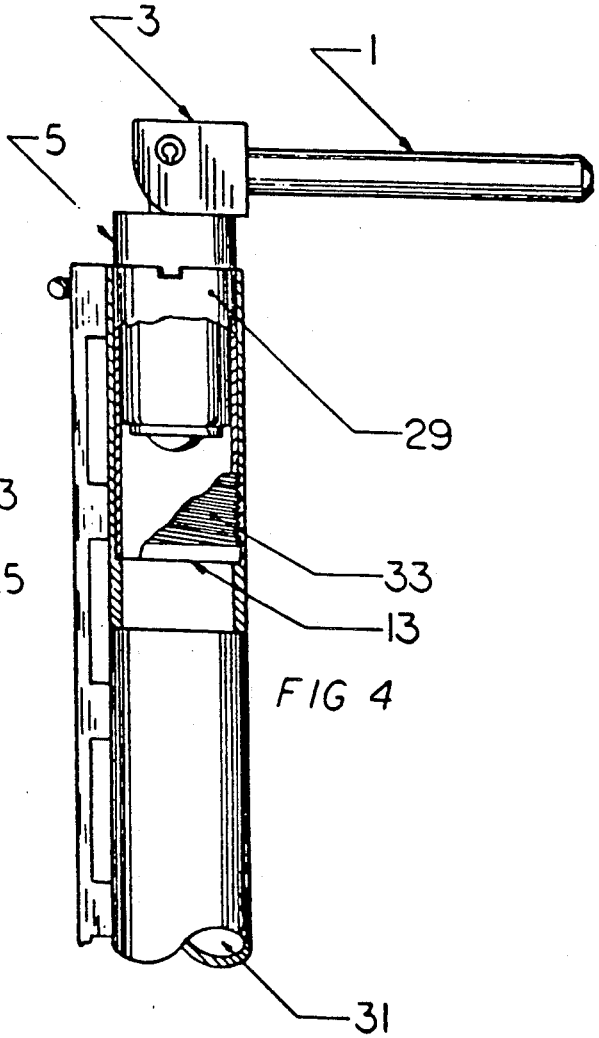
FIG. 4 is a side elevational view of the present invention as inserted into and secured to a shotgun choke tube.

FIG. 3 is a representation of the choke tube wrench engagement with the barrel 29 of a shot gun. This figure shows the insertion. The wrench assembly is shown inserted into the choke tube 13 of the gun barrel 29 and the projections 9 of the choke key 5 are shown in engagement with the notches 11 of the choke tube. FIG. 4 shows the device after the handle 1 has been turned, rotating the cam 3 ninety degrees (90°). This movement of the cam 3 causes the puller bar 15 to be drawn toward the cam, which results in compression of the expanding element 23 along its length. In turn, there is expansion of the expanding element 23 along its diameter, which secures the choke tube wrench in the choke tube 13. This also simultaneously firmly pulls the choke key 5 against the choke tube 13. At this point the handle 1, having been rotated by about ninety degree (90°) becomes a lever which greatly aids in unscrewing the choke tube 13 from barrel threads 33.

Although the invention has been described in terms of specific embodiments and applications, persons skilled in the art, in light of this teaching, can generate additional and varying embodiments without department from the spirit, or without exceeding the scope of the claimed invention. Accordingly, it is to be understood that the drawings and descriptions in this disclosure are proffered to facilitate comprehensions of the invention, and should not be construed to limit the scope thereof.

What is claimed is:

1. A choke tube wrench for removing or installing a threaded choke tube, said choke tube having a proximal end and a distal end and having a plurality of notches in said proximal end, in a shotgun barrel having a muzzle opening, said proximal end of said choke tube lying nearer said muzzle opening, comprising:

an elastic expanding element having an initial diameter and a proximal end and a distal end;

means for expanding said elastic expanding element; and a handle attached to said means for expanding;

wherein said elastic expanding element is inserted into said shotgun barrel, said proximal end of said elastic expanding element lying nearer said muzzle opening, so that once said means for expanding said elastic expanding element are actuated, said initial diameter increases until said elastic expanding element tightly engages said choke tube, at which point said handle can be turned, transmitting a torque to said choke tube and turning said choke tube.

2. A choke tube wrench as in claim 1 further comprising a choke key, said choke key being disposed adjacent to said proximal end of said elastic expanding element.

3. A choke tube wrench as in claim 2, said choke key having a number of projections corresponding to said plurality of notches whereby when said handle is turned said torque is transmitted through said projections of said choke key to said choke tube, helping to turn said choke tube.

4. A choke tube wrench as in claim 2 wherein said choke key has an opening having a shape, said elastic expanding element has a bore running along its length and said means for expanding said elastic element further comprises:

a cam, to which said handle is attached;

a puller bar having a shape corresponding to said shape of said opening in said choke key, said puller bar having a proximal end and a distal end, said proximal end being attached to said cam, said puller bar passing through and slidably engaging said opening in said choke key, and also passing through said bore in said elastic expanding element; and a washer, said washer being attached to said distal end of said puller bar, said washer being adjacent to said distal end of said elastic expanding element, whereby when said handle is turned, said cam pivots, pulling said puller bar toward said cam, said puller bar drawing said washer toward said cam, said elastic expanding element being compressed between said washer and said choke key so that said diameter increases.

* * * * *